US011940149B2

(12) United States Patent
Coscia

(10) Patent No.: US 11,940,149 B2
(45) Date of Patent: Mar. 26, 2024

(54) ELEVATED FLARE SYSTEM FOR BURNING TWO TYPES OF GAS

(71) Applicant: L'Air Liquide, Société Anonyme pour l'Etude et l'Exploitation des Procédés Georges Claude, Paris (FR)

(72) Inventor: Antonio Coscia, Hadamar (DE)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 99 days.

(21) Appl. No.: 17/146,620

(22) Filed: Jan. 12, 2021

(65) Prior Publication Data

US 2021/0215337 A1 Jul. 15, 2021

(30) Foreign Application Priority Data

Jan. 13, 2020 (EP) ..... 20020019

(51) Int. Cl.
*F23G 7/08* (2006.01)

(52) U.S. Cl.
CPC ..... *F23G 7/085* (2013.01)

(58) Field of Classification Search
None
See application file for complete search history.

(56) References Cited

U.S. PATENT DOCUMENTS 3,822,984 A 7/1974 Straitz, III
2020/0355367 A1* 11/2020 Ball, IV ..... F23G 7/085

FOREIGN PATENT DOCUMENTS

CN 102758973 A * 10/2012 ..... F16L 9/18
DE 10 2007 027819 12/2008
GB 1 011 196 10/1964

OTHER PUBLICATIONS

Ullmann's Encyclopedia of Industrial Chemistry, B. Elvers, S. Hawkins, M. Ravenscroft, J.F. Rounsaville, G. Schulz, eds., 5th (1996) and 6th (2000) editions, 1-2, 77-82, 161-162, 270-271, 399-407.

European Search Report for corresponding EP 20020019.4, dated Jun. 15, 2020.

* cited by examiner

*Primary Examiner* — Jason Lau
(74) *Attorney, Agent, or Firm* — Elwood L. Haynes

(57) ABSTRACT

An elevated flare system in a synthesis gas production plant for thermal disposal of offgases having at least two different contents of carbon monoxide arising in synthesis gas production and/or synthesis gas treatment.

6 Claims, 1 Drawing Sheet

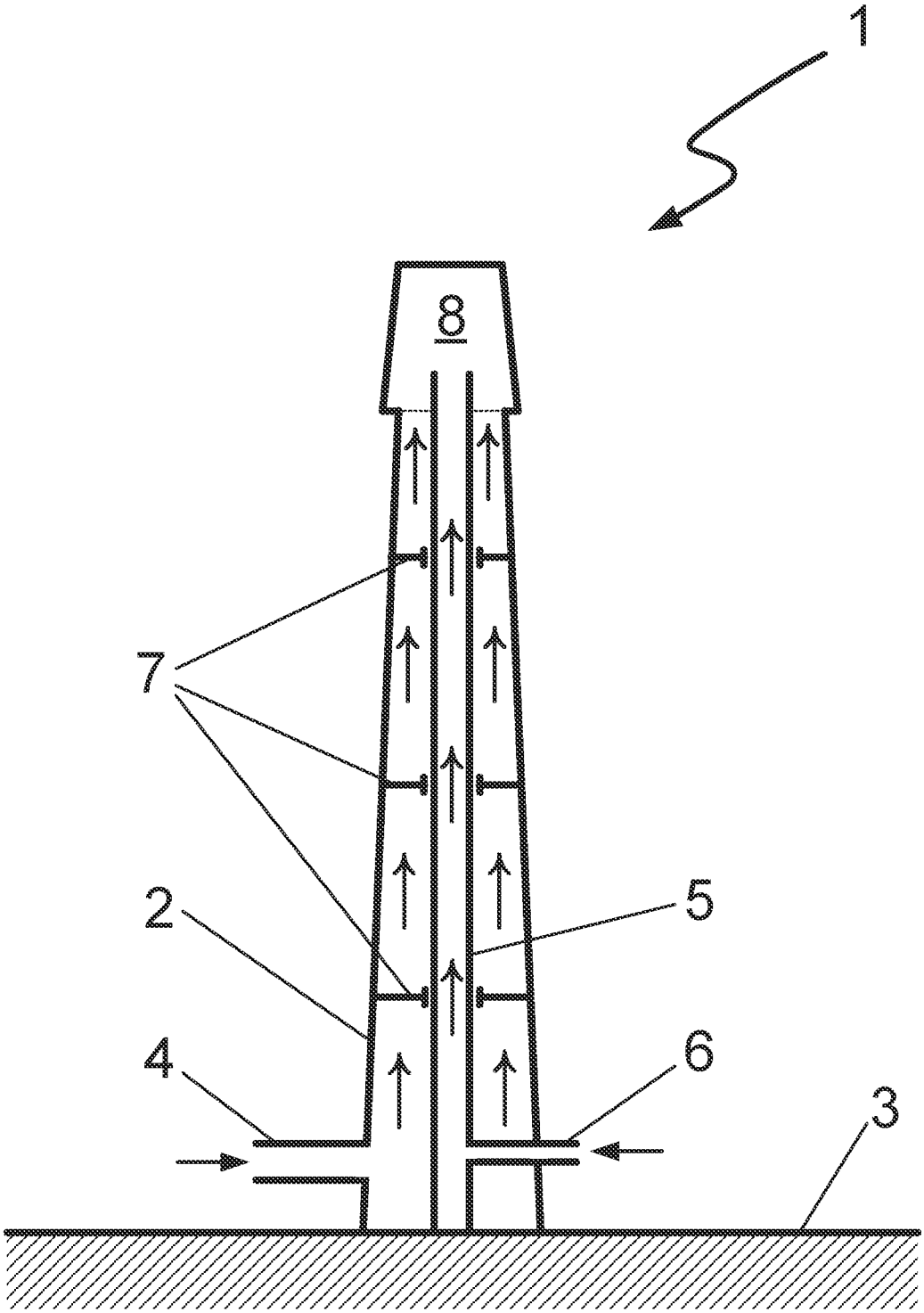
1
8
7
2
5
4
6
3

ELEVATED FLARE SYSTEM FOR BURNING TWO TYPES OF GAS

CROSS REFERENCE TO RELATED APPLICATIONS

This application claims the benefit of priority under 35 U.S.C. § 119 (a) and (b) to European Patent Application No. 20020019.4, filed Jan. 13, 2020, the entire contents of which are incorporated herein by reference.

Field of the Invention

The invention relates to an elevated flare system in a synthesis gas production plant for thermal disposal of offgases having at least two different contents of carbon monoxide (CO content) arising in synthesis gas production and/or synthesis gas treatment, in particular for the simultaneous flaring or burning of hot synthesis gas and cryogenic, low-temperature carbon monoxide.

The invention further relates to a process for burning two types of gas obtained in a synthesis gas production plant.

BACKGROUND

Prior Art

A gas flare or simply flare is a device for deliberate flaring, i.e. deliberate burning, of combustible gases which are not to be or cannot be utilized in terms of energy or material. Gas flares are frequently used when discontinuously large amounts of such gases are to be expected, as can be the case during, for example, start-up and running-down procedures and production malfunctions. Gas flares convert offgas constituents into the relatively environmentally-unfriendly and climate-damaging carbon dioxide by combustion.

Significant components of a gas flare are the actual burner, one or more pilot burners to ignite the latter, pipes for supplying the gases to be flared off, optionally a support construction and also control and safety devices for safe operation of the flare.

Apart from the ground flares which are encountered less often, the most frequent type of flare systems used at present is the elevated flare. In these systems, the flare tip containing the burner is mounted at the upper end of the flare system at a certain height above the ground or the erection surface, which reduces thermal radiation to the ground or to the erection substrate and improves the dispersion profile for pollutants to be flared off or the combustion products thereof. The feed pipes are configured as riser pipes. The totality of riser pipes, burner and optionally support construction is usually referred to as flare stack or else simply as flare, with the terminological distinction not being sharply defined.

The prior art for flare systems is described in the API standards 521 and 537.

There are in principle the following types of elevated flares:

a) self-supporting flare stacks are often used for relatively low construction heights with limited erection space or ground area. They are normally restricted to one flare stack or one riser pipe. Their construction height can be up to 100 m. A dedicated liquid precipitator for separating off condensate is usually not necessary.

b) guy rope- or guy wire-supported flare stacks generally require more ground area than self-supporting or derrick-supported flare stacks. Their construction height can be up to 250 m. The flare is usually restricted to one riser pipe and a specific liquid precipitator is frequently necessary.

c) flare stacks having a stand or tripod as support device are suitable only for relatively small, simple flares.

d) derrick flares having drilling tower-like support frameworks or support frames are, because of the greater outlay, used only in the case of relatively large flare stacks in the case of which a self-supporting configuration is not feasible or possible and a guy rope-supported flare stack is not possible because of the erection space available. Very great construction heights are possible. Some derrick designs make it possible to lower the flare stack and the flare tip for inspection and maintenance. This is particularly useful if a plurality of flare stacks are installed on the same derrick (known as a multiflare derrick) for space reasons. A dedicated liquid precipitator for separating off condensate is usually necessary.

Flare systems of the type described are used not only in petrochemical plants but also in synthesis gas production plants in order to dispose of, by burning, gas product streams or offgas streams which temporarily cannot be processed further within the process chain or for which there is momentarily no other disposal possibility. Synthesis gases are gas mixtures containing hydrogen and carbon oxides which are used in various synthesis reactions.

The production of the crude synthesis gas, for example by steam reforming, autothermal reforming or partial oxidation of hydrocarbon-containing feeds, is usually followed by a plurality of process steps for removing undesirable gas constituents, for example methane, by cryogenic gas fractionation in a so-called CO cold box. In this, carbon monoxide can be obtained as pure product, or a synthesis gas stream having an adjusted hydrogen/carbon monoxide ($H_2$/CO) ratio can be obtained, by means of substeps such as methane scrub, partial condensation and CO scrub. The pure CO product is discharged from the CO cold box as low-temperature gas stream because of the cryogenic gas fractionation.

In synthesis gas production plants, flaring of synthesis gas (20 to 300° C.) and cryogenic CO (−180° C.) is typically necessary in order to protect the synthesis gas production plant in the case of malfunctions or planned downtimes of the entire synthesis gas production plant or of parts thereof and in order to dispose of, by burning, gas product streams or offgas streams which temporarily cannot be processed further within the process chain or for which there is momentarily no other disposal possibility.

For the elevated flare systems employed in practice for burning synthesis gas and cryogenic CO (CO gas), there have hitherto been various technical approaches whose configurations depend, inter alia, on the $H_2$/CO ratio of the synthesis gas to be burnt.

A flare system of a first type (type 1) can be used in synthesis gas production plants when the main product of the plant is synthesis gas having a high $H_2$/CO ratio or is exclusively hydrogen. The small amount of CO gas which in this case has to be processed in the flare system can be conveyed through a small, external riser pipe which is made of a corrosion-resistant material, for example a high-alloy steel such as stainless steel, and is conducted upward on the outside of the main flare stack to the upper end of the main flare stack made of carbon steel (C steel). The pipe which conveys the cryogenic CO gas from the cryogenic gas fractionation is particularly preferably to be made of a fully austenitic stainless steel, since unalloyed and low-alloy steels are extremely brittle at the typical low temperatures of the CO gas, which greatly increases the probability of failure, especially when cyclic mechanical stresses occur (e.g. oscillation of the stack due to wind, pressure pulses, etc.). Fully austenitic stainless steels have a very high low-temperature toughness compared to unalloyed and low-alloy steels. They thus have a toughness behaviour at very low temperatures which is similar to that at room temperature. The critical factor for use of such materials having a low-temperature toughness is not the CO content but the temperature of the gas; as a guide, a high-alloy material having low-temperature toughness generally has to be selected at temperatures of −50° C. or below.

At the upper end of the main flare stack, synthesis gas and CO gas are burnt in respectively dedicated burners specifically designed for the particular gases. In order to compensate for the different thermal expansion due to the use of different materials of construction for main flare stack and CO riser pipe and the high pressure drop, a sufficient number and size of expansion bends has to be ensured in the configuration of the riser pipe. This construction results in additional loads to be borne by the main flare stack, which limits the maximum possible total height for a self-supporting system before a change to a derrick flare becomes necessary.

The advantage of a flare of type 1 is that each burner can be optimized in respect of maximum safety and performance in destroying the pollutants present in the offgas taking into account the gas to be flared off or burnt. In order to ensure, for example, a high degree of degradation or degree of incineration of the pollutants and at the same time to prevent detachment of the flame from the burner tip, the exit velocity for many flare systems should not exceed 25 to 30 m/s. This value can be greater than 150 m/s in the case of synthesis gas.

The elevated flare system of a second type (type 2) resembles type 1 but encompasses a combined burner configuration in which the cold, CO-rich gas from the cryogenic gas fractionation is injected into the common main burner at the same level as the synthesis gas. When the $H_2$/CO ratio of the synthesis gas produced in the synthesis gas production plant decreases to such an extent that the synthesis gas contains more CO than hydrogen, a dedicated CO burner becomes too large to be able to be mounted at the upper end of the flare stack in addition to the main burner. For this reason, a combined burner configuration of type 2 then offers advantages.

However, this construction comes up against limits as soon as the CO gas stream becomes the main stream, as a result of which the CO riser pipe becomes too large and heavy. In addition, the additional injection of the CO gas into the common burner can in individual cases with simultaneous burning of the synthesis gas result in local gas velocities which incur the risk of detachment of the flame from the burner tip.

The elevated flare system of a third type (type 3) is used in cases having a very large flow of the CO gas compared to the flow of synthesis gas. As in the case of type 1, dedicated burners designed for the particular purpose are provided here for each of the flare gas streams. A disadvantage of this configuration is the need for a stable support framework, for example of the derrick design, in order to be able to bear the increased loads caused by the two completely separate feed conduit and burner systems. This also requires a larger area for the construction.

Overall, it can therefore be said that there continues to be a need for a simply constructed elevated flare system which allows a plurality of types of gas from a synthesis gas production plant, for example CO gas and synthesis gas having a wide $H_2$/CO ratio, to be flared off next to one another and preferably simultaneously and thus to be safely disposed of thermally.

SUMMARY

It is therefore the object of the present invention to propose a novel elevated flare system which overcomes the previous disadvantages of the prior art. In particular, the objective is to provide an elevated flare system having a self-supporting flare stack which can be employed over the total range occurring in practice of the $H_2$/CO ratios occurring in the product gases or offgases from a synthesis gas production plant.

The terms synthesis gas production plant and synthesis gas production process encompass all processes in which synthesis gas, i.e. gas mixtures containing hydrogen and carbon oxides, is firstly obtained as crude product gas.

Possibilities for producing synthesis gas are in principle all known synthesis processes employed in industrial production, i.e., in particular, steam reforming of hydrocarbons, especially of natural gas (steam methane reforming, SMR) or else, for example, of naphtha or refinery residues, the noncatalytic partial oxidation of hydrocarbons (POX) or the autothermal reforming as mixed form of the two abovementioned processes.

An often multistage treatment is usually carried out on the crude synthesis gas produced in this way. The treatment steps comprise, in particular, carrying out one or more cooling steps with or without steam generation, heat exchange of the crude synthesis gas to be cooled and of the flue gas produced by the burners for preheating process media, CO converting (CO shift) to maximize the hydrogen content, steps for removing carbon dioxide, e.g. by means of a gas scrub using amine-containing scrubbing media, and measures for separating off other gas constituents to be separated off, for example methane, traces of higher hydrocarbons or carbon monoxide as pure product by cryogenic gas fractionation in a so-called cold box. In the latter, mainly liquid methane or liquid nitrogen is used to absorb relatively high-boiling gases such as carbon monoxide and to thus separate them from hydrogen.

A coaxial arrangement of two pipes is understood to be an arrangement in which the axes of rotation of the two pipes in the longitudinal direction coincide.

The term low-alloy refers to steels in which the sum of the alloying elements does not exceed a content of 5% by mass. If this content is exceeded, the term high-alloy steels is employed. Examples are carbon steel (C steel) as low-alloy steel and high-grade steel, in particular stainless high-grade steel, as high-alloy steel.

Qualitative information, for example low or relatively low or high or relatively high CO content, are always to be understood as qualitative with regard to the ratio of two or more streams of material under consideration.

The elevated flare system of the invention comprises, in one embodiment, a flare stack having a concentrically arranged stainless steel riser pipe as inner pipe, the outer wall of which forms a radially uniformly spaced annular space with the interior wall of the outer pipe. In the interior of the stainless steel riser pipe, the cold CO gas originating from the cryogenic gas fractionation is conveyed to the upper end of the flare stack at which the burner is arranged.

The synthesis gas flows through the annular space between the inner pipe and the outer pipe, which can be made of an unalloyed or low-alloy steel, e.g. C steel, and is in this way likewise conducted to the upper end of the flare stack.

This configuration makes it possible to employ the flare stack of the invention for a wide range of $H_2$/CO ratios, in particular all $H_2$/CO ratios occurring in product gases or offgases from a synthesis gas production plant. The diameter of the inner pipe is designed for the maximum flow of the CO gas. The internal diameter of the outer pipe is then determined by the external diameter of the inner pipe and the ratio of the area of the annular space and the pressure difference which is acceptable in order to allow transport of the synthesis gas stream within the flare stack.

The outer pipe is also statically designed so that the load of the total arrangement of the flare stack, i.e. the outer pipe, inner pipe and burner, can be borne. An external support framework is not necessary.

The inner pipe is fastened at the lower end of the flare stack, conducted upwards within the outer pipe and can preferably be centred at one or more levels by means of spacers along its course. The spacers are more preferably configured as sliding bearings at the end opposite to the fastening point. This and the coaxial arrangement allows a free length change of the inner pipe relative to the outer pipe, which is necessary when the inner pipe and the outer pipe are manufactured from materials having different coefficients of thermal expansion, without additional compensation measures being required.

Owing to the construction according to the invention of the flare stack, the burner receives the CO gas through a central nozzle into which the inner pipe opens at its upper end. The synthesis gas goes from the upper end of the annular space, arranged around the CO nozzle, into the burner. This symmetrical configuration leads to particularly uniform combustion.

Furthermore, this arrangement prevents streak formation and thus locally excessively high gas velocities at the burner, which can be too high for the gases to be flared off to be reliably burnt, due to nonuniformities at the individual introduction points in the case of a gas stream to be flared off which is introduced into the burner in a distributed manner at a number of discrete points around a circumference. Calculation of the resulting mixed gas velocities of the gases in the burner is also made simpler by their areal distribution in the burner.

Since the choice of the burner size is not mechanically restricted but can instead be selected relatively freely by the choice of a compatible size of the outer pipe or a compatible ratio of outer pipe to inner pipe and appropriate dimensioning of, for example, external pipes and distributors, the inner pipe can in any case be made large enough to attain any intended low flow velocity of the CO gas. Should it be necessary for safe and reliable burning, a further reduction in the flow velocity of the CO gas can be achieved by selecting an appropriately large burner diameter.

Further advantageous effects of the invention arise from the coaxial arrangement of the inner pipe in the interior of the outer pipe. The two types of gas to be flared off also have different temperatures in addition to their different CO content. Synthesis gas as end product or intermediate to be flared off usually has temperatures in the range from 20 to 300° C. On the other hand, CO gas to be flared off from cryogenic gas fractionation is often in the low-temperature state with temperatures of around −180° C. The arrangement according to the invention of inner pipe and outer pipe therefore acts as cocurrent heat exchanger, so that the temperature differences between the two types of gas conveyed in the flare stack decrease through to the exit into the burner, which leads to more uniform combustion and a more homogeneous flame profile over the cross section of the burner.

A second aspect of the elevated flare system of the invention is characterized in that it is constructed and erected in a free-standing manner. Support frameworks and support constructions can therefore be dispensed with, which leads to reduced capital costs. Furthermore, the place where the flare stack is erected can be changed more quickly should this become necessary in the context of new usages of areas within the production operation.

A third aspect of the elevated flare system of the invention is characterized in that the first offgas pipe and the second offgas pipe have a circular cross section and the second offgas pipe runs coaxially as inner pipe in the interior of the first offgas pipe as outer pipe, with a radially uniformly spaced annular space being formed between the outside of the inner pipe and the inside of the outer pipe. This brings about a more uniform distribution of the gas to be flared off flowing through the annular space and thus more uniform combustion in the burner and decreased corrosion phenomena, especially at the interior wall of the outer pipe.

A fourth aspect of the elevated flare system of the invention is characterized in that the arrangement of inner pipe and outer pipe is made possible by a plurality of spacers, with in each case at least two, preferably at least three, spacers being arranged radially at a particular height of the elevated flare system and being fastened to the inside of the outer pipe or to the outside of the inner pipe. In this way, the inner pipe can be reliably centred relative to the outer pipe. It is advisable to provide such groups of spacers at at least different heights. Particular preference is given to providing at least three spacers in each case which are arranged in the form of a triangle or a flat tripod perpendicular to the longitudinal axis of the pipes.

A fifth aspect of the elevated flare system of the invention is characterized in that the spacers are configured as sliding bearings at the end opposite to the fastening point. Since inner pipe and outer pipe consist, according to the invention, of different materials having, in general, different coefficients of thermal expansion and the temperature differences between the annular space and the interior space of the inner pipe (central space) are considerable and change significantly over the levels of the flare stack, it is advantageous to ensure that the relative change in length of the two pipes relative to one another can occur unhindered so that no mechanical stresses which could lead to deformations occur. This is achieved by the configuration of the spacers as sliding bearings.

A sixth aspect of the elevated flare system of the invention is characterized in that the outer pipe consists of a low-alloy or unalloyed steel, preferably C steel, and the inner pipe consists of a high-alloy steel, preferably stainless steel, in particular stainless steel which is tough at low temperature. The CO gas originating from the cryogenic gas fractionation has a low temperature and therefore places increased demands on the material of the inner pipe in respect of embrittlement thereof at the prevailing operating conditions compared to the other type of gas. It is therefore advantageous to make the inner pipe through the interior space of which the CO gas is conveyed to the burner of a material having a particularly good low-temperature toughness. This is not absolutely necessary for the outer pipe whose inside is contacted by the other type of gas, so that a low-alloy or unalloyed steel as cheaper material can be used here.

A seventh aspect of the elevated flare system of the invention is characterized in that the first offgas has a lower CO content than the second offgas and is conveyed through the annular space between the inside of the outer pipe and the outside of the inner pipe. This has the advantages mentioned above in connection with the explanation of the sixth aspect: the offgas having the higher temperature and/or having the lower corrosion potential is conveyed through the annular space.

An eighth aspect of the elevated flare system of the invention is characterized in that the second offgas has a higher CO content than the first offgas and is conveyed through the inner pipe. This has the advantages mentioned above in connection with the explanation of the sixth aspect: the offgas having the higher temperature and/or having the lower corrosion potential is conveyed through the annular space.

In a further aspect, the process of the invention is characterized in that the first product stream or offgas stream comprises a synthesis gas stream to be disposed of or is formed by this. The CO content of synthesis gas streams which arise as intermediates or end products in a synthesis gas production plant is lower than that of CO gas from cryogenic gas fractionation, so that the corrosion potential of the first product stream or offgas stream is less than that of the second product stream or offgas stream. It is advantageous to convey the offgas having the lower corrosion potential through the annular space, as explained in connection with the sixth aspect of the invention.

In a further aspect, the process of the invention is characterized in that the second product stream or offgas stream comprises an offgas stream having a high CO content from the plant for cryogenic gas fractionation or is formed by such an offgas stream. The CO content of CO gas from cryogenic gas fractionation is higher than that of synthesis gas streams which arise as intermediates or end products in a synthesis gas production plant, so that the corrosion potential of the second product stream or offgas stream is higher than that of the first product stream or offgas stream. It is also advantageous to convey the colder offgas having the higher corrosion potential and/or embrittlement potential through the central space, as explained in connection with the sixth aspect of the invention.

BRIEF DESCRIPTION OF THE DRAWING

Further developments, advantages and possible uses of the invention may also be derived from the following description of working examples and the drawings. All features described and/or depicted form, either in themselves or in any combination, the invention, regardless of the way they are combined in the claims or the back-references therein.

FIG. 1 illustrates a working example of an elevated flare system according to the invention in a schematic depiction.

DETAILED DESCRIPTION OF THE PREFERRED EMBODIMENTS

In the schematic depiction in FIG. 1, the elevated flare system 1 according to the invention comprises a flare stack having an outer pipe 2 made of C steel. The outer pipe is erected in a free-standing manner on a flat substrate 3 and is sealed against this. It has a circular cross section and is cylindrical or preferably has the shape of a frustum of a cone with a slight taper in the upward direction. The wall thickness of the outer pipe is made such that the loads of the total elevated flare system with the main components outer pipe, inner pipe and burner can be borne. Synthesis gas which is obtained temporarily as offgas in a synthesis gas production plant (not shown) is introduced by a feed conduit 4 into the flare stack at the underside thereof. The temperature of the synthesis gas offgas can be between 20 and 300° C. It depends mainly on the position or assembly within the synthesis gas production plant from which the offgas is to be taken. Thus, it is about 300° C. at a position downstream of the production stage for the crude synthesis gas, for example a steam reformer. During the course of the subsequent treatment stages, it drops ever further and is typically between 20 and 50° C., for example 40° C., before introduction into the concluding pressure swing adsorption stage for pure hydrogen production.

The inner pipe 5 is arranged in the interior space of the outer pipe and is likewise erected on the flat substrate 3 and sealed against the latter. It consists of a high-alloy steel, for example stainless steel which is tough at low temperature, and has a circular cross section. CO gas which is obtained temporarily as offgas in a plant for the cryogenic fractionation (not shown) of the crude synthesis gas produced or previously treated synthesis gas is introduced by a feed conduit 6 into the flare stack at the underside thereof and conveyed further to the inner pipe 5 and introduced into the latter. Here, the feed conduit 6 is conducted through the outer pipe 2, with the position of the passage being sealed off against the surroundings. The CO gas has a temperature of −180° C. It is preferably conveyed through a liquid precipitator (not shown) to separate off any condensates before being introduced into the inner pipe.

In the present working example, the inner pipe is fixed in position relative to the outer pipe by means of spacers 7 which are provided at three different heights of the flare stack. The spacers are fastened to the interior wall of the outer pipe and are configured as sliding bearings on the side facing the inner pipe. In each case three spacers each at an angle of 120° to one another are provided at each height.

The diameter of the inner pipe is designed for the maximum flow of the CO gas. The internal diameter of the outer pipe is then determined by the external diameter of the inner pipe and the ratio of the area of the annular space and the pressure difference which is acceptable for allowing transport of the synthesis gas stream within the flare stack. In choosing the diameter, it needs to be ensured that the flow velocity at the burner mouth is small enough to prevent detachment of the burner flame even at the maximum flow of the two types of gas at the same time. The maximum flow velocity under these conditions may have to be determined by preliminary tests.

In the flare stack, the synthesis gas offgas is conveyed from the bottom upwards through the annular space formed between the inside of the outer pipe and the outside of the inner pipe and finally introduced into the common burner 8. The CO gas offgas flows upwards in the interior space of the inner pipe (central space) and likewise goes into the common burner. There, the offgases are ignited by means of an ignition or pilot burner (not shown) and burnt. The oxygen required for this purpose is taken from the surrounding air. In order to assist combustion, steam can additionally be injected into the burner. The combustion products which arise are discharged into the surroundings.

REFERENCE NUMERALS

[1] Elevated flare system
[2] Outer pipe

[3] Substrate
[4] Feed conduit
[5] Inner pipe
[6] Feed conduit
[7] Spacer
[8] Common burner

What is claimed is:

1. A process for the thermal disposal of offgases comprising at least two different contents of carbon monoxide arising in synthesis gas production and/or synthesis gas treatment, comprising, an elevated flare system comprising at least two different contents of carbon monoxide arising in synthesis gas production and/or synthesis gas treatment, comprising:

(a) a first offgas pipe which is arranged perpendicularly to the horizontal and comprising a first material and a feed conduit for an offgas comprising a first CO content to the first offgas pipe, (b) a second offgas pipe which is arranged perpendicularly to the horizontal and comprising a second material and a feed conduit for an offgas comprising a second CO content to the second offgas pipe, (c) wherein the first offgas pipe and the second offgas pipe are arranged coaxially and at their upper end open into a common burner, wherein the first offgas pipe and the second offgas pipe have a circular cross section and the second offgas pipe runs coaxially as inner pipe in the interior of the first offgas pipe as outer pipe, with a radially uniformly spaced annular space being formed between the outside of the inner pipe and the inside of the outer pipe, wherein the first offgas has a lower CO content than the second offgas and is conveyed through the annular space between the inside of the outer pipe and the outside of the inner pipe:

the process comprising:

(a) producing a crude synthesis gas containing hydrogen and carbon oxides from a hydrocarbon-containing feed by means of a synthesis gas production process, (b) treating the crude synthesis gas in a multistage treatment thereby producing a pure synthesis gas, comprising a plant for cryogenic gas fractionation as one of the treatment steps, (c) discharging a first product stream or offgas stream comprising a low CO content and introducing into the annular space between the inside of the outer pipe and the outside of the inner pipe of the elevated flare system, (d) discharge of a second product stream or offgas stream having a high CO content and introduction into the inner pipe of an elevated flare system, (e) burning of the first product stream or offgas stream and of the second product stream or offgas stream in the common burner.

2. A process for the thermal disposal of offgases comprising at least two different contents of carbon monoxide arising in synthesis gas production and/or synthesis gas treatment, comprising an elevated flare system comprising at least two different contents of carbon monoxide arising in synthesis gas production and/or synthesis gas treatment, comprising:

(a) a first offgas pipe which is arranged perpendicularly to the horizontal and comprising a first material and a feed conduit for an offgas comprising a first CO content to the first offgas pipe, (b) a second offgas pipe which is arranged perpendicularly to the horizontal and comprising a second material and a feed conduit for an offgas comprising a second CO content to the second offgas pipe, (c) wherein the first offgas pipe and the second offgas pipe are arranged coaxially and at their upper end open into a common burner, wherein the first offgas pipe and the second offgas pipe have a circular cross section and the second offgas pipe runs coaxially as inner pipe in the interior of the first offgas pipe as outer pipe, with a radially uniformly spaced annular space being formed between the outside of the inner pipe and the inside of the outer pipe, wherein the second offgas has a higher CO content than the first offgas and is conveyed through the inner pipe:

the process comprising:

(a) producing a crude synthesis gas containing hydrogen and carbon oxides from a hydrocarbon-containing feed by means of a synthesis gas production process, (b) treating the crude synthesis gas in a multistage treatment thereby producing a pure synthesis gas, comprising a plant for cryogenic gas fractionation as one of the treatment steps, (c) discharging a first product stream or offgas stream comprising a low CO content and introducing into the annular space between the inside of the outer pipe and the outside of the inner pipe of an elevated flare system, (d) discharge of a second product stream or offgas stream having a high CO content and introduction into the inner pipe of the elevated flare system, (e) burning of the first product stream or offgas stream and of the second product stream or offgas stream in the common burner.

3. The process according to claim 1, wherein the first product stream or offgas stream comprises a synthesis gas stream to be disposed of.

4. The process according to claim 2, wherein the first product stream or offgas stream comprises a synthesis gas stream to be disposed of.

5. Process according to claim 1, wherein the second product stream or offgas stream comprises an offgas stream having a high CO content from the plant for cryogenic gas fractionation or is formed by such an offgas stream.

6. Process according to claim 2, wherein the second product stream or offgas stream comprises an offgas stream having a high CO content from the plant for cryogenic gas fractionation or is formed by such an offgas stream.

* * * * *